US008113211B2

(12) United States Patent
Evans et al.

(10) Patent No.: US 8,113,211 B2
(45) Date of Patent: Feb. 14, 2012

(54) MULTI COMPONENT CIGARETTE FILTER ASSEMBLY

(75) Inventors: James D. Evans, Chesterfield, VA (US); G. Robert Scott, Midlothian, VA (US); Steven F. Spiers, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 755 days.

(21) Appl. No.: 11/830,287

(22) Filed: Jul. 30, 2007

(65) Prior Publication Data

US 2008/0078416 A1 Apr. 3, 2008

Related U.S. Application Data

(60) Provisional application No. 60/847,826, filed on Sep. 28, 2006.

(51) Int. Cl.
*A24C 5/47* (2006.01)

(52) U.S. Cl. ..... 131/94; 493/43; 493/47; 493/50; 493/39

(58) Field of Classification Search ..... 131/35, 131/37

See application file for complete search history.

(56) References Cited

U.S. PATENT DOCUMENTS

| | | | | |
|---|---|---|---|---|
| 3,094,450 | A * | 6/1963 | Davidson | 156/209 |
| 4,174,720 | A | 11/1979 | Hall | |
| 4,281,591 | A * | 8/1981 | Boegli et al. | 493/45 |
| 4,303,080 | A | 12/1981 | Boegli et al. | |
| 4,386,998 | A | 6/1983 | McIntyre et al. | |
| 4,427,744 | A | 1/1984 | Hume, III | |
| 5,613,504 | A * | 3/1997 | Collins et al. | 131/94 |
| 7,004,896 | B2 | 2/2006 | Heitmann et al. | |
| 2002/0119874 | A1 * | 8/2002 | Heitmann et al. | 493/39 |
| 2005/0282693 | A1 | 12/2005 | Garthaffner et al. | |
| 2008/0078416 | A1 * | 4/2008 | Evans et al. | 131/94 |

FOREIGN PATENT DOCUMENTS

GB 1243977 8/1971

* cited by examiner

*Primary Examiner* — Richard Crispino
*Assistant Examiner* — Michael J. Felton
(74) *Attorney, Agent, or Firm* — Connolly Bove Lodge & Hutz LLP

(57) ABSTRACT

A cigarette filter assembly comprises a hollow paper tube with a spaced apart solid fiber plugs inside the tube together with granular filter material in the spaces between the plugs. Energy activated adhesive is only between the solid filter plugs and interior surface portions of the tube. After the spaced apart solid fiber plugs are within the tube the adhesive is activated to secure the plugs to the tube. The energy activated adhesive is only on selected portions of the hollow tube where the solid fiber plugs are located or alternatively the adhesive is only on the exterior surface portions of the solid fiber plugs.

18 Claims, 1 Drawing Sheet

MULTI COMPONENT CIGARETTE FILTER ASSEMBLY

CROSS REFERENCE TO RELATED APPLICATION

The present application claims the benefit of provisional application Ser. No. 60/847,826, filed Sep. 28, 2006, for all useful purposes, and the specification and drawings thereof are included herein by reference.

BACKGROUND OF THE INVENTION

The present invention comprises a multi component cigarette filter assembly comprising a hollow filter tube with spaced apart solid fiber plugs inside the tube and granular filter material between the plugs, and more particularly to such an assembly where the solid fiber plugs are secured to interior portions of the tube by energy activated adhesive selectively applied only between the plugs and the tube.

U.S. application Ser. No. 11/268,291, filed Nov. 4, 2005, claiming the benefit of earlier filed provisional application Ser. No. 60/625,747, filed Nov. 5, 2004, describes and illustrates a vertical filter filling machine and process. The disclosure of each of these applications is incorporated herein by reference, and each application describes and illustrates a preferred filter tube of paper with hollow ends and a solid center of cellulose acetate or similar material for producing two multi cavity cigarette filters. The filter tube is vertically oriented and moves along a generally circular path where metered amounts of granular filter material are initially deposited in the tube against the solid center. Thereafter, a plug of cellulose acetate or similar material is placed in the tube to thereby seal the granular material in place. A second deposit of a different granular material is then placed in the tube and a second plug seals that material in place. Subsequently, the tube is inverted and the remaining half is filled with granular material and sealed in the same manner. Cutting the tube midway through the solid center thereof produces two individual multiple cavity cigarette filters. The assembled filter tube forms a two-up dual filter which when combined with wrapped tobacco rods at each end thereof ultimately produces two complete cigarettes when cut midway through the solid center. Each individual cigarette filter may have a length of 30 mm, but can be shorter or longer, if desired.

Fundamentally, the solid fiber plugs are retained within the hollow filter tube by frictional engagement between the exterior surface of the plugs and the interior surface of the hollow filter tube.

SUMMARY OF THE INVENTION

The primary object of the present invention is a multi component cigarette filter assembly where solid filter plugs are positively secured to selected and predetermined locations within the hollow filter tube of the assembly by energy activated adhesive, the adhesive only being located between the solid plugs and interior surface portions of the tube.

In accordance with the present invention, a cigarette filter assembly comprises a hollow tube with spaced apart solid plugs inside the tube and energy activated adhesive only between the solid plugs and interior surface portions of the tube. After the spaced apart solid plugs are within the tube the adhesive is activated to thereby positively secure the plugs to the tube.

In one embodiment of the present invention the energy activated adhesive is only on selected interior portions of the tube where the solid plugs are located, and the adhesive may comprise one or more bands at each location of the solid plugs. Alternatively, the energy activated adhesive may be on exterior portions of the solid plugs, and the adhesive may comprise one or more bands on each solid plug.

In a preferred embodiment of the present invention a cigarette filter assembly comprises a hollow tube with a solid plug centrally located within the tube. First granular material is located within the tube at opposite ends of the centrally located solid plug. First solid plugs are positioned adjacent the first granular material, and second granular material is adjacent the first solid plugs. Second solid fiber plugs are positioned adjacent the second granular material. Energy activated adhesive is only between first and second plugs and interior surface portions of the hollow tube whereby after the first and second solid plugs are within the tube the adhesive is activated to secure the plugs to the tube.

The energy activated adhesive is only on selected interior portions of the hollow tube where the first and second solid plugs are located. The adhesive may comprise one or more bands at each solid plug location. Alternatively, the energy activated adhesive may be on the exterior surface portions of the first and second solid plugs, and the adhesive may comprise one or more bands on each plug.

Preferably the centrally located solid plug and the first and second solid plugs each comprise cellulose acetate fibers. Moreover, the first and second granular material may be selected from the group consisting of carbon beads, carbon granules and any other known particulate material useful in cigarette filters.

BRIEF DESCRIPTION OF THE DRAWINGS

Novel features and advantages of the present invention in addition to those mentioned above will be readily apparent to persons of ordinary skill in the art from a reading of the following detailed description in conjunction with the accompanying drawings wherein similar reference characters refer to similar parts and in which.

DETAILED DESCRIPTION OF THE INVENTION

Figures 1, 2, 3, 4, 5:
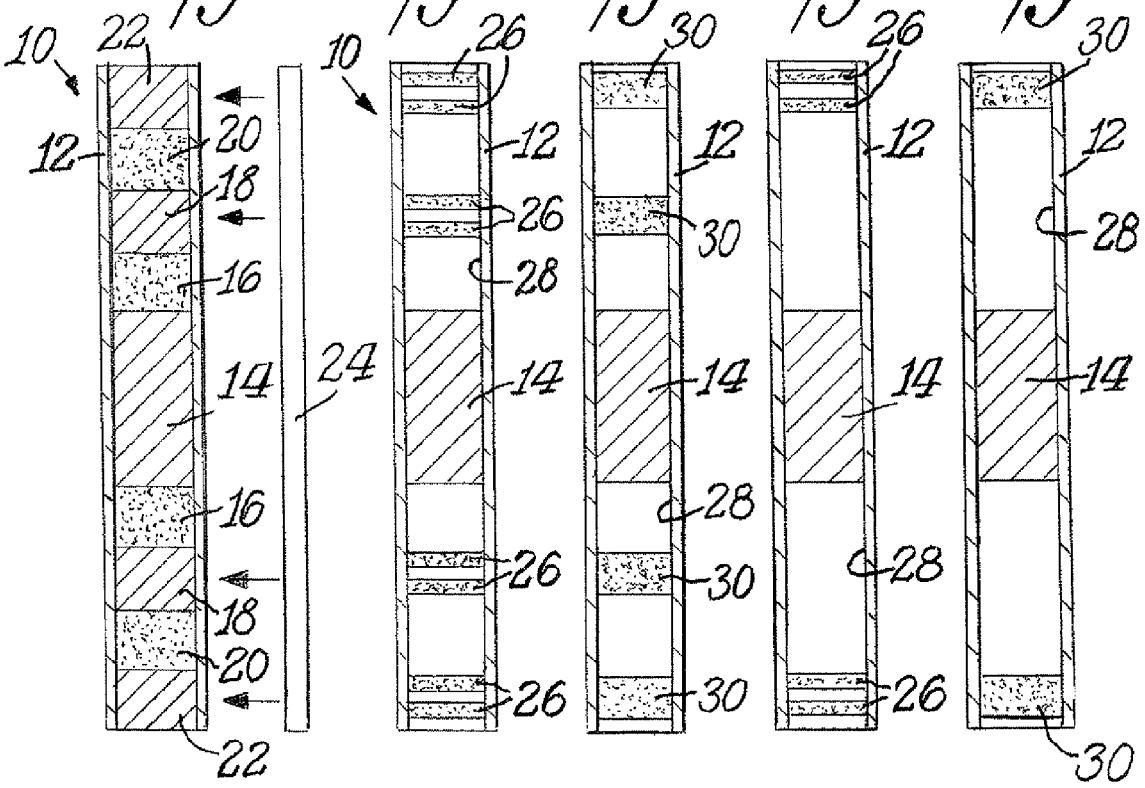
FIG. 1 is a cross sectional view in elevation of a multi component cigarette filter assembly in accordance with the present invention, and diagrammatically illustrating a heating device for activating the energy activated adhesive only applied between the solid plugs and interior surface portions of the filter tube.
FIG. 2 is a cross sectional view in elevation of a hollow filter tube with a solid plug centrally located within the tube and bands of energy activated adhesive inside the tube at locations where other solid plugs are ultimately positioned.
FIG. 3 is a sectional view in elevation similar to FIG. 2, but illustrating the adhesive at each solid plug location as a single band of adhesive.
FIG. 4 is a cross-sectional view in elevation similar to FIG. 2, but only having adhesive at the outer ends of the hollow filter tube.
FIG. 5 is a cross sectional view in elevation similar to FIG. 3, but only having adhesive at the outer ends of the hollow filter tube.

Referring in more particularity to the drawings, FIG. 1 illustrates a multi component cigarette filter assembly 10 which forms a two-up dual filter. When the assembly 10 is combined with wrapped tobacco rods (not shown), one at each end thereof, two complete cigarettes are ultimately produced when the assembly is cut at its midpoint.

Fundamentally the cigarette filter assembly 10 comprises a paper tube 12 with a solid fiber plug 14 centrally located within the tube. Particulate filter material 16 such as granulated carbon or carbon beads, for example, is located adjacent the centrally located fiber plug 14 at the opposite ends thereof. An inside solid plug 18 is positioned against each deposit of the particulate material to thereby seal the material in place. Another charge of particulate material 20 is deposited against each inside solid plug 18 and such material may be the same or different from the particulate material 16. Ultimately the particulate material 20 is sealed in place within paper tube 12 by end solid plugs 22.

As explained above, the upper half of the paper tube 12 is often filled with particulate material 16, 20 and solid plugs 18, 22, and the tube may then be inverted to fill the opposite end in a similar manner. Each assembly 10 produces an a pair of individual cigarette filters each having an approximate length of 30 mm, but the length can be shorter or longer, if desired.

As explained more fully below, the end plugs 22 are positively secured to the inner surface of the paper tube 12 by energy activated adhesive. Alternatively, both the end plugs 22 and the inside solid plugs 18 may be secured to the paper tube 12 by energy activated adhesive. The adhesive is such that upon activation it melts or otherwise becomes tacky to secure the plugs to the paper tube. Prior to activation the adhesive remains dry and does not interfere with overall production of the filter assembly 10. Heat 24 may be applied thereafter to melt the adhesive and secure the plugs to the interior surface of the paper tube 12 where the plugs are located.

In FIG. 2 several bands of energy activated adhesive 26 are applied to the interior surface 28 of paper tube 12 at those predetermined locations where the solid plugs 18 and 22 are ultimately positioned. After the cigarette filter assembly is completed energy such as heat 24 is applied to the bands 26 of the adhesive to thereby melt the adhesive and secure the plugs 18, 22 to the interior surface 28 of the paper tube 12. It is important that the adhesive is only applied to those locations inside the paper tube where the plugs will ultimately be positioned. No adhesive is located in the cavities between the plugs where the particulate material 16, 20 is ultimately deposited.

FIG. 3 is similar to FIG. 2, but the adhesive is applied as a single band 30 rather than the multiple bands 26. Otherwise the assembly 10 is the same.

FIGS. 4 and 5 illustrate modified embodiments of the present invention where the energy activated adhesive is only applied on the interior surface 28 of the paper tube 12 where the end plugs 22 are ultimately positioned. The interior solid plugs 18 are held in position by frictional engagement with the paper tube 12 as well as by the deposits of particulate material 16, 20 at opposite ends of the plugs 18. FIG. 4 illustrates the energy activated adhesive applied as multiple bands 26 while FIG. 5 illustrates a single band 30 of adhesive. Otherwise the paper tubes are the same.

Figures 6, 7:
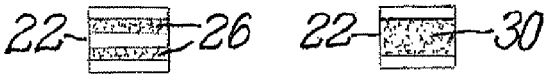
FIG. 6 is a front elevational view of a solid plug with bands of adhesive on the outer surface thereof.
FIG. 7 is a front elevational view of a solid plug with a single band of energy activated adhesive on the exterior thereof.

FIGS. 6 and 7 illustrate other modifications of the present invention where the adhesive is applied to the exterior of one or both solid plugs 18, 22 rather than the adhesive being pre-applied to the interior of the paper tube. In FIG. 6 the solid end plug 22 includes several bands 26 of energy activated adhesive on the exterior surface of the plug while in FIG. 7 a single band 30 is applied. Both solid plugs 18 and 22 may include adhesive on the exterior thereof in the form of multiple bands or a single band. Alternatively, the adhesive may simply by applied to the exterior of the end plugs 22.

The plugs 14, 18 and 22 are preferable made from cellulose acetate fibers. However, other plug configurations may also be used such as solid plugs with one or more passageways therethrough that allow smoke flow through the plugs of the filter.

What is claimed is:

1. A cigarette filter assembly comprising a hollow tube with spaced apart solid plugs inside the tube and energy activated adhesive only between the solid plugs and interior surface portions of the tube whereby after the spaced apart solid plugs are within the tube at least a portion of the adhesive is activated to secure the plugs to the tube.

2. A cigarette filter assembly as in claim 1 wherein the energy activated adhesive is only on selected interior portions of the tube where the solid plugs are located.

3. A cigarette filter assembly as in claim 2 wherein the energy activated adhesive comprises plural bands of adhesive at each location of each solid plug.

4. A cigarette filter assembly as in claim 1 wherein the energy activated adhesive is on exterior surface portions of the solid plugs.

5. A cigarette filter assembly as in claim 4 wherein the energy activated adhesive comprises plural bands of adhesive on each solid plug.

6. A cigarette filter assembly comprising a hollow tube with a plug centrally located within the tube, first granular material within the tube at opposite ends of the centrally located solid plug, first solid plugs adjacent the first granular material, second granular material within the tube adjacent the first solid plugs, second solid plugs adjacent the second granular material, and energy activated adhesive only between the first and second solid plugs and interior surface portions of the hollow tube whereby after the first and second solid plugs are within the tube the adhesive is activated to secure the plugs to the tube.

7. A cigarette filter assembly as in claim 6 wherein the energy activated adhesive is only on selected interior portions of the hollow tube where the first and second solid plugs are located.

8. A cigarette filter assembly as in claim 7 wherein the energy activated adhesive comprises plural bands of adhesive at each location of each solid plug.

9. A cigarette filter assembly as in claim 6 wherein the energy activated adhesive is on exterior surface portions of the first and second solid plugs.

10. A cigarette filter assembly as in claim 9 wherein the energy activated adhesive comprises plural bands of adhesive on each solid plug.

11. A cigarette filter assembly as in claim 6 wherein the centrally located solid plug and the first and second solid plugs each comprise cellulose acetate fibers.

12. A cigarette filter assembly as in claim 6 wherein the first and second granular material is selected from the group consisting of carbon beads and carbon granules.

13. A method of making a filter assembly of a smoking article, the method comprising:

disposing an energy activated adhesive along an interior surface of a filter tube limited essentially to spaced apart locations;

inserting plural filter plugs at the spaced-apart locations along the interior of the filter tube;

activating at least a portion of the adhesive to secure the filter plugs at the spaced apart locations.

14. The method of claim 13, wherein the activating is limited essentially to the spaced apart locations.

15. The method of claim 14, wherein the disposing of the adhesive includes disposing plural bands of adhesive at each of the spaced apart locations.

16. A cigarette filter assembly comprising a hollow tube with spaced apart solid plugs inside the tube and energy activated adhesive only between the solid plugs and selected interior portions of the tube where the solid plugs are located wherein the energy activated adhesive comprises plural bands of adhesive at each location of each solid plug whereby after the spaced apart solid plugs are within the tube at least a portion of the adhesive is activated to secure the plugs to the tube.

17. A cigarette filter assembly comprising a hollow tube with plug centrally located within the tube, first granular material within the tube at opposite ends of the centrally located solid plug, first solid plugs adjacent the first granular material, second granular material within the tube adjacent the first solid plugs, second solid plugs adjacent the second granular material wherein the centrally located solid plug and the first and second solid plugs each comprise cellulose acetate fibers and the first and second granular material is selected from the group consisting of carbon beads and carbon granules, and energy activated adhesive comprises plural bands of adhesive at each location of each solid plug only on selected interior portions between the first and second solid plugs and interior surface portions of the hollow tube where the first and second solid plugs are located whereby after the first and second solid plugs are within the tube the adhesive is activated to secure the plugs to the tube.

18. A method of making a filter assembly of a smoking article, the method comprising:

disposing an energy activated adhesive along an interior surface of a filter tube limited essentially to spaced apart locations wherein the disposing of the adhesive includes disposing plural bands of adhesive at each of the spaced apart locations;

inserting plural filter plugs at the spaced-apart locations along the interior of the filter tube;

activating at least a portion of the adhesive to secure the filter plugs at the spaced apart locations wherein the activating is limited essentially to the spaced apart locations.

* * * * *